US007193166B2

(12) United States Patent
Sakurai

(10) Patent No.: US 7,193,166 B2
(45) Date of Patent: Mar. 20, 2007

(54) JOYSTIC INPUT DEVICE

(75) Inventor: Junichi Sakurai, Tokyo (JP)

(73) Assignee: Niles Co., Ltd. (JP)

( * ) Notice: Subject to any disclaimer, the term of this patent is extended or adjusted under 35 U.S.C. 154(b) by 0 days.

(21) Appl. No.: 11/498,156

(22) Filed: Aug. 3, 2006

(65) Prior Publication Data

US 2007/0029176 A1 Feb. 8, 2007

(30) Foreign Application Priority Data

Aug. 5, 2005 (JP) ..... 2005-228756
Aug. 5, 2005 (JP) ..... 2005-228757

(51) Int. Cl.
*H01H 25/04* (2006.01)

(52) U.S. Cl. ..... 200/5 R; 200/6 A

(58) Field of Classification Search ..... 200/4, 200/5 R, 6 A, 17 R, 18; 341/20, 22, 35; 345/156, 157, 161, 163, 168, 169, 184
See application file for complete search history.

(56) References Cited

U.S. PATENT DOCUMENTS 5,621,196 A * 4/1997 Nishijima et al. ..... 200/6 A
6,184,480 B1 * 2/2001 Nishimoto et al. ..... 200/4
6,262,378 B1 * 7/2001 Chou ..... 200/4
6,396,006 B1 * 5/2002 Yokoji et al. ..... 200/4
6,423,911 B2 * 7/2002 Yoshida et al. ..... 200/6 A
6,657,141 B1 * 12/2003 Myojin ..... 200/6 A
6,720,504 B2 * 4/2004 Nishimoto et al. ..... 200/4
6,953,900 B2 * 10/2005 Sottong ..... 200/5 R

FOREIGN PATENT DOCUMENTS

JP 2005-122290 A 5/2005
JP 2005-122294 A 5/2005
JP 20005-122289 A 5/2005

* cited by examiner

*Primary Examiner*—Michael A Friedhofer
(74) *Attorney, Agent, or Firm*—Rader, Fishman & Grauer PLLC; Ronald P. Kananen

(57) ABSTRACT

A joystic device allows a knob to perform parallel movement, turning and depressing operations by a single operation of the knob. The device is provided with a knob formed of a non-turning portion in a center, and an operating portion provided to the non-turning portion so as to be relatively turnable such that a parallel movement operation and a depressing operation of the non-turning portion and the operating portion, and a turning operation of the operating portion are performed with respect to a case, and a parallel operating portion that supports the knob to allow the parallel movement and depressing operations of the non-turning portion and the operating portion, and the turning operation of the operating portion while receiving a turning regulation with respect to the case. In response to the operations of the parallel movement, turning, and depressing through the non-turning portion and the operating portion, corresponding one of detecting portions is operated.

24 Claims, 13 Drawing Sheets

JOYSTIC INPUT DEVICE

CROSS-REFERENCE TO RELATED APPLICATION

This application is based on Japanese Patent Application No. 2005-228756 and 2005-228757 both Aug. 5, 2005 the disclosure of which is incorporated herein by reference.

BACKGROUND OF THE INVENTION

1. Technical Field

The invention relates to a JOYSTIC INPUT DEVICE for an automobile that is allowed to perform such operations as parallel movement, turning, and depression.

2. Related Art

FIG. 15 is a cross sectional view of a generally employed JOYSTIC INPUT DEVICE. In the generally employed JOYSTIC INPUT DEVICE shown in FIG. 15, a tilt/depression knob 203 for tilting and depressing operations and a turn knob 204 for turning operations are attached to a case 201 so as to operate contacts in response to the respective operations.

When the tilt/depression knob 203 is tilted, a tilt member 205 tilts to operate the contact. When the turn knob 204 is turned, a rotor 207 is rotated accompanied with the turn knob 204 so as to detect turning operations. When the tilt/depression knob 203 is depressed, a depression member 209 is depressed in an axial direction to activate the contact.

The aforementioned device requires the user to operate different knobs 203 and 204 when changing operations from tilting/depressing to turning.

Patent Document 1: Patent Application Publication No. 2005-122294

Patent Document 2: Patent Application Publication No. 2005-122289

Patent Document 3: Patent Application Publication No. 2005-122290

SUMMARY OF THE INVENTION

The need of operating different knobs to change operations from tilting/depressing to turning is considered as the problem to be solved by the invention.

According to the invention, a knob is formed of a non-turning portion in a center, and an operating portion provided to the non-turning portion so as to be relatively turnable such that a parallel movement operation and a depressing operation of the non-turning portion and the operating portion, and a turning operation of the operating portion are performed with respect to a case, and a parallel operating portion that supports the knob to allow the parallel movement and depressing operations of the non-turning portion and the operating portion, and the turning operation of the operating portion while receiving a turning regulation with respect to the case so as to allow the parallel movement, turning, and depressing operations to be performed by a single operation of a knob.

The JOYSTIC INPUT DEVICE according to the invention is provided with a knob formed of a non-turning portion in a center, and an operating portion provided to the non-turning portion so as to be relatively turnable such that a parallel movement operation and a depressing operation of the non-turning portion and the operating portion, and a turning operation of the operating portion are performed with respect to a case, and a parallel operating portion that supports the knob to allow the parallel movement and depressing operations of the non-turning portion and the operating portion, and the turning operation of the operating portion while receiving a turning regulation with respect to the case. This makes it possible to allow the parallel movement, turning, and depressing operations to be performed by a single operation of a knob.

The parallel operating portion allows the parallel movement, turning, and depressing operations to be performed by a single operation of a knob.

DESCRIPTION OF PREFERRED EMBODIMENTS

First Embodiment

[Structure of Joystic Switch]

Figure 1:
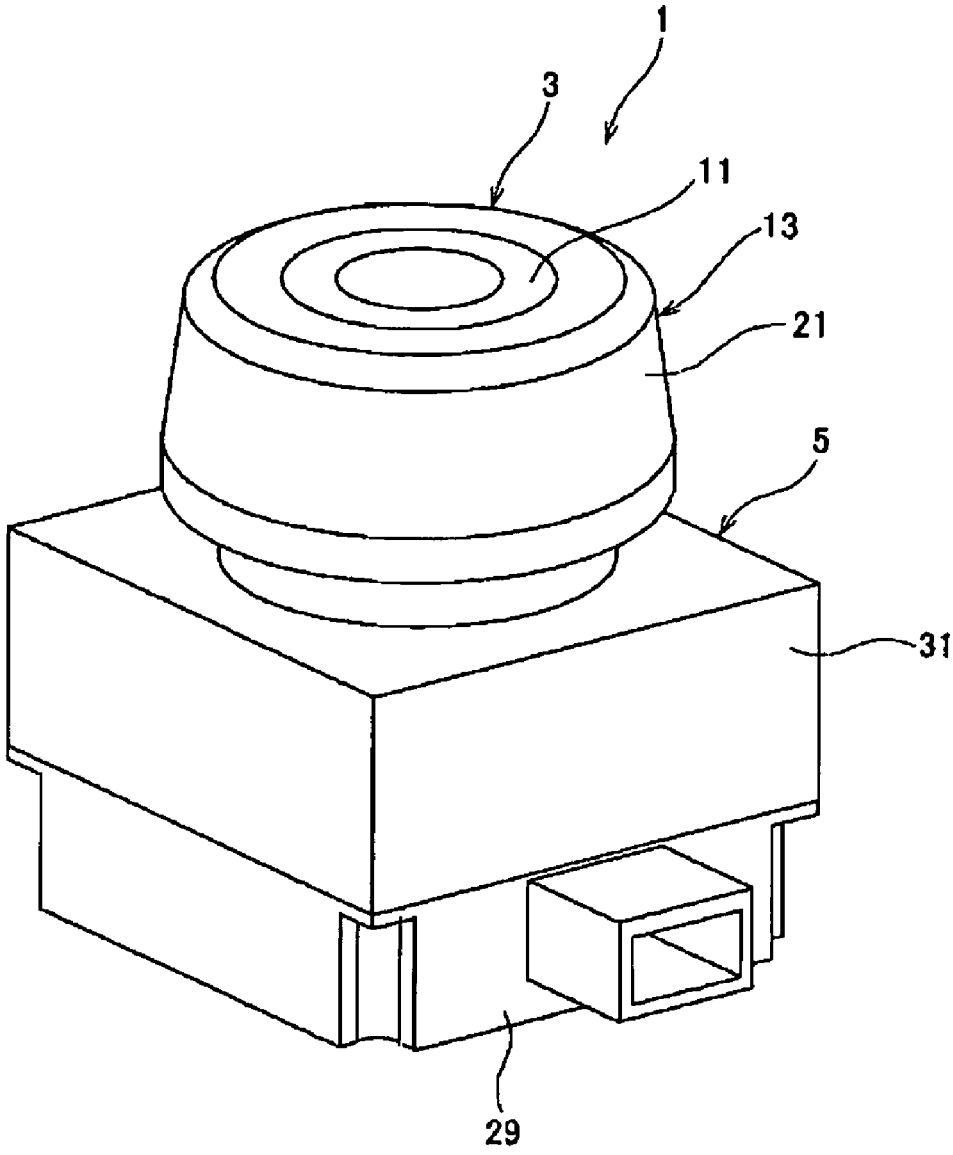
FIG. 1 is a perspective view of a joystic switch (First embodiment)
Figure 2:
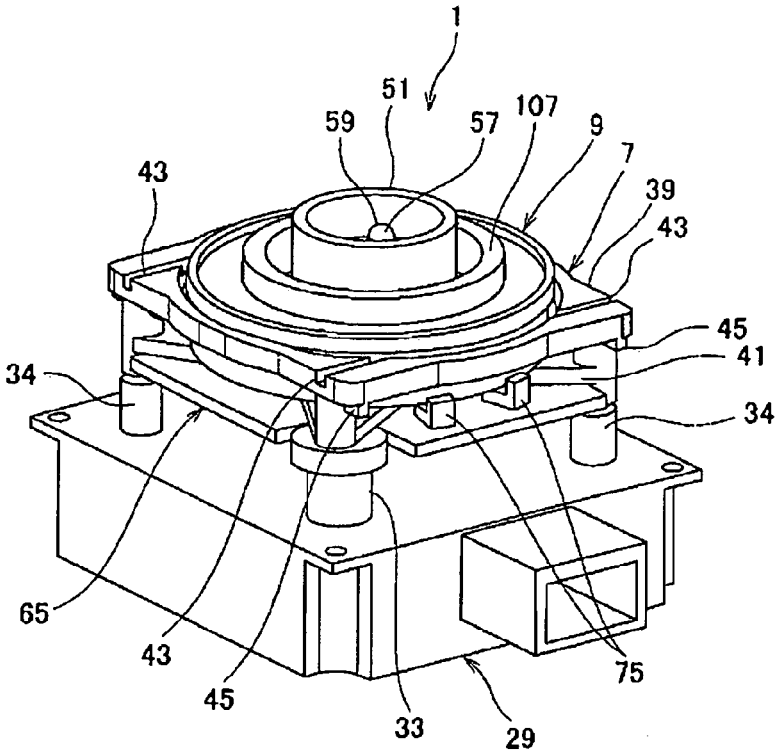
FIG. 2 is a perspective view of the joystic switch having the knob and the upper case removed (First embodiment)
Figure 3:
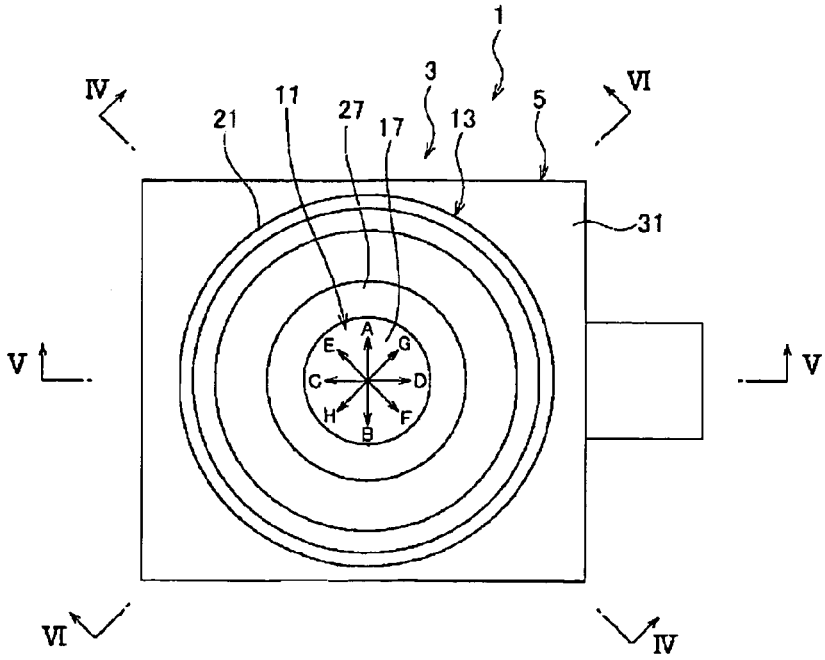
FIG. 3 is a plan view of the joystic switch (First embodiment)
Figure 4:
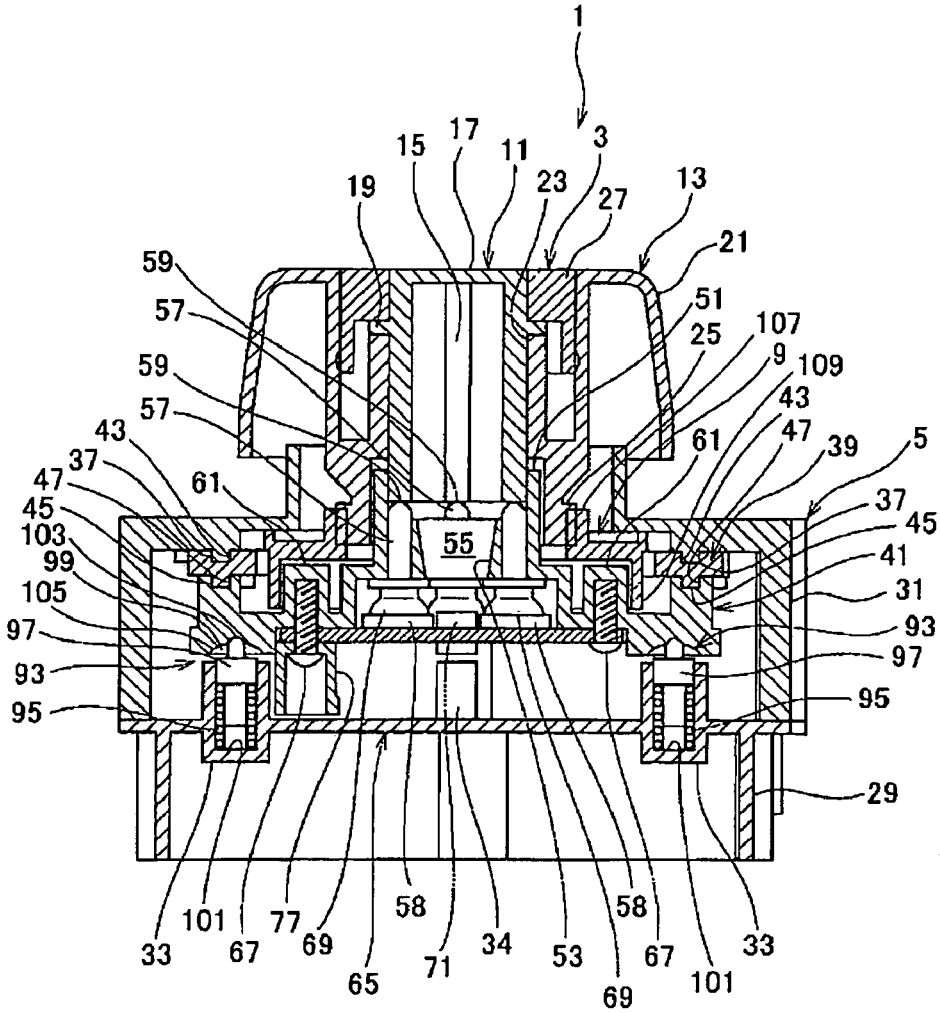
FIG. 4 is a sectional view taken on line IV—IV of FIG. 3 (First embodiment)
Figure 5:
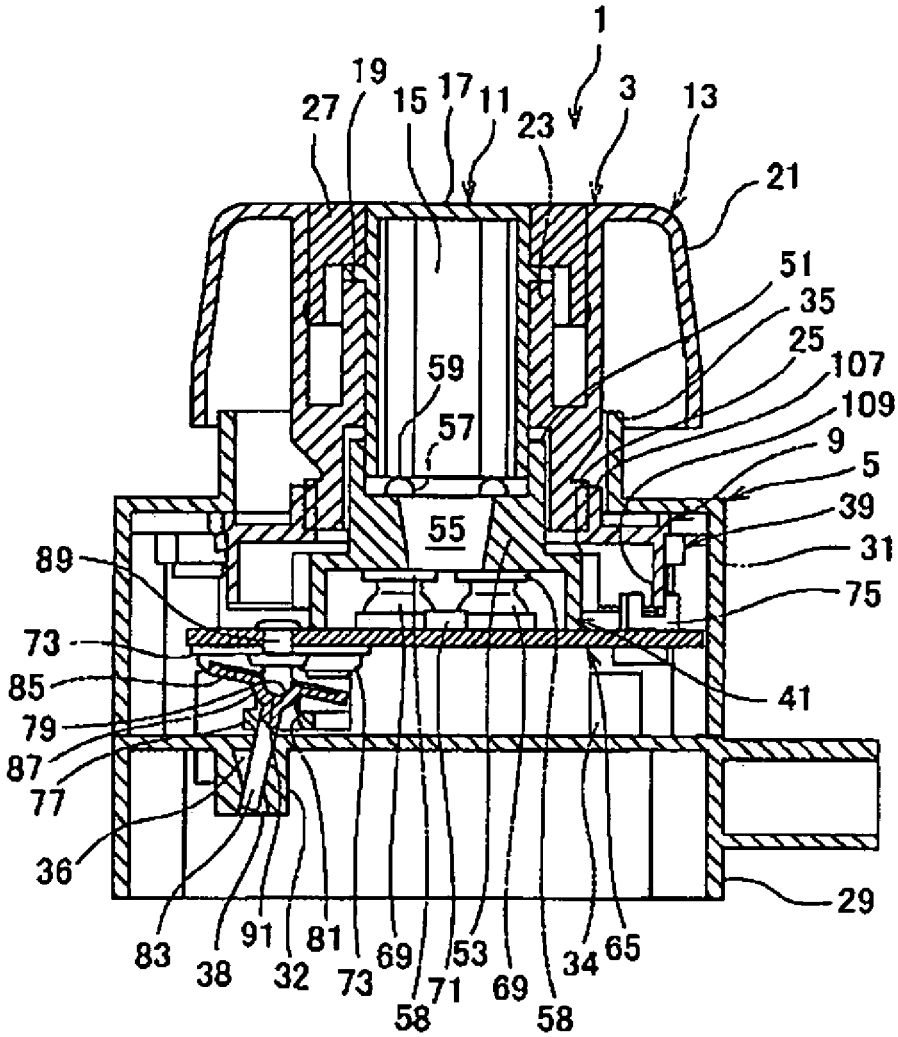
FIG. 5 is a sectional view taken on line V—V of FIG. 3 (First embodiment)
Figure 6:
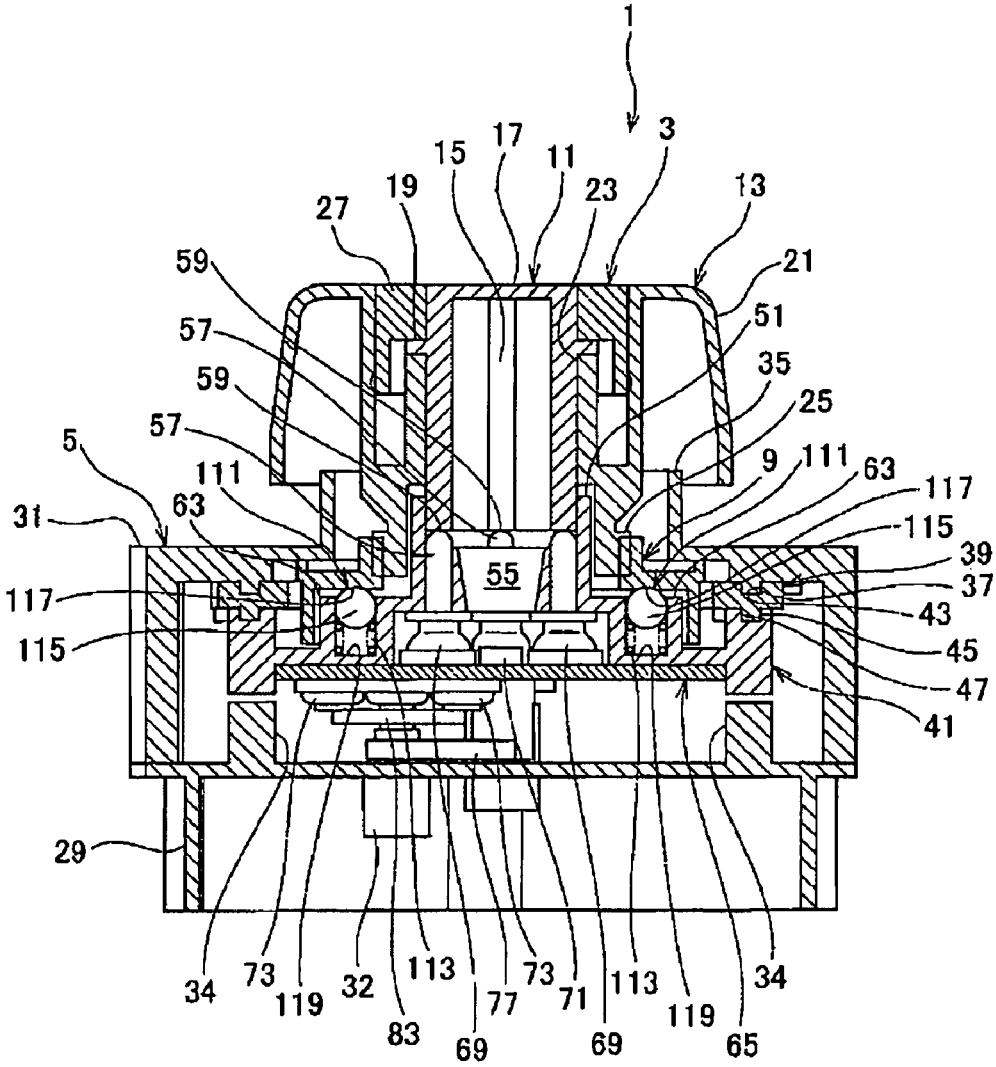
FIG. 6 is a sectional view taken on line VI—VI of FIG. 3 (First embodiment)
Figure 7:
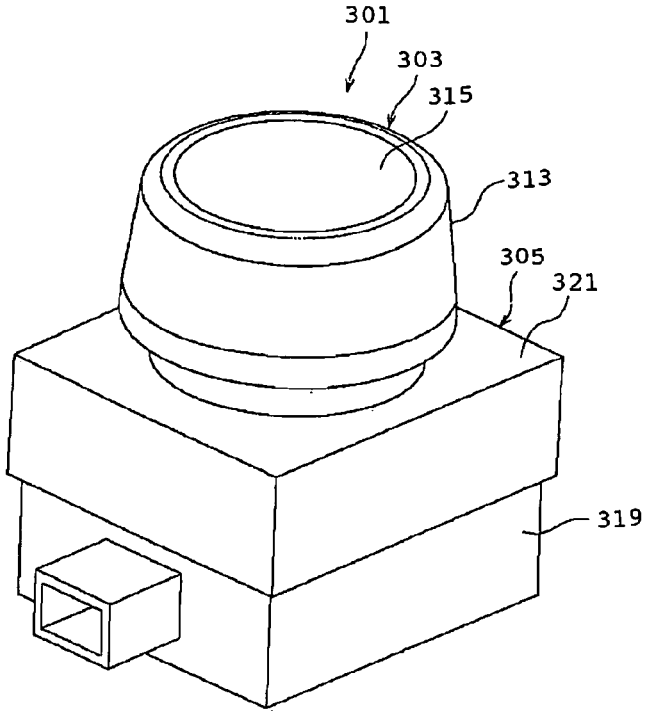
FIG. 7 is a perspective view of a joystic switch (Second embodiment)
Figure 8:
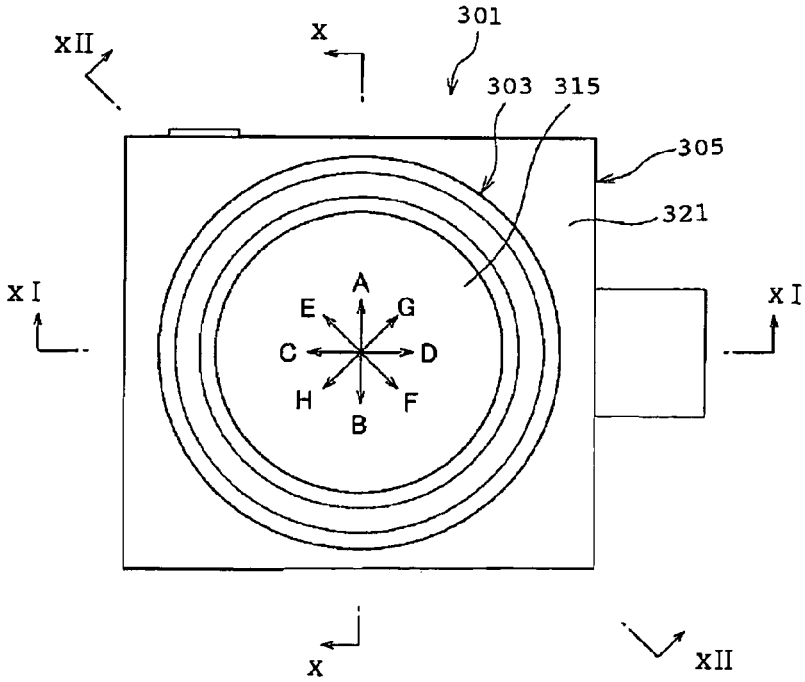
FIG. 8 is a plan view of the joystic switch (Second embodiment)
Figure 9:
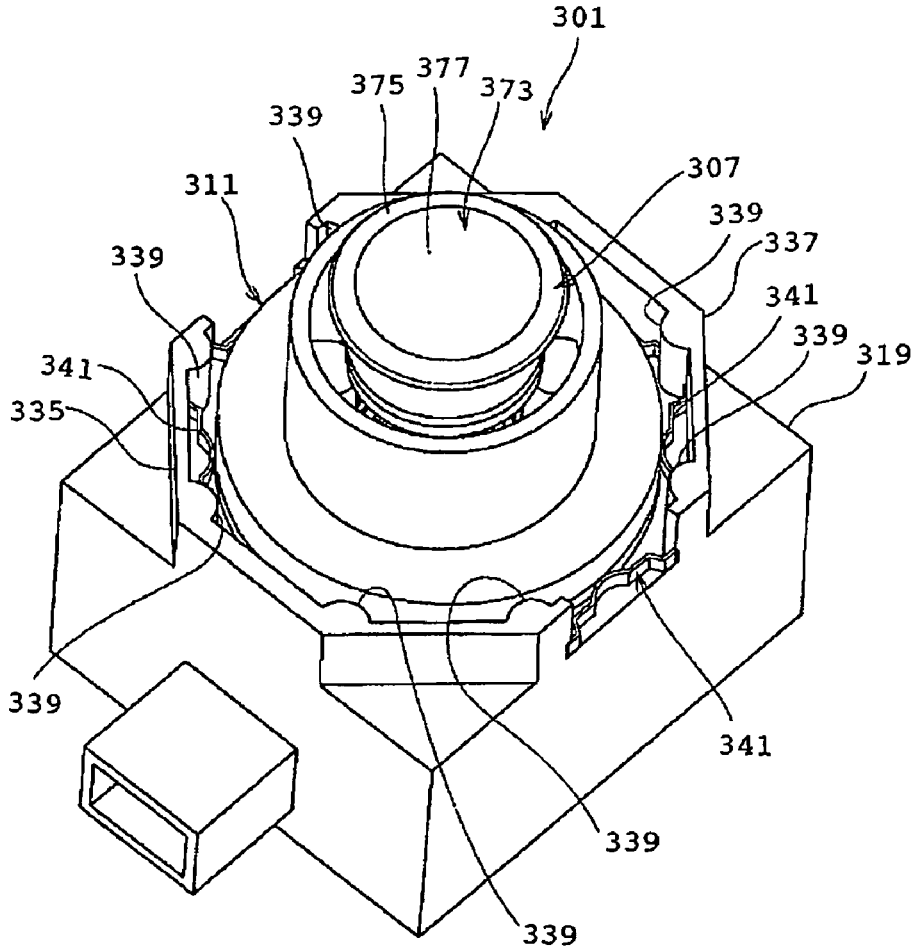
FIG. 9 is a perspective view of the joystic switch having the knob and the upper case removed (Second embodiment)
Figure 10:
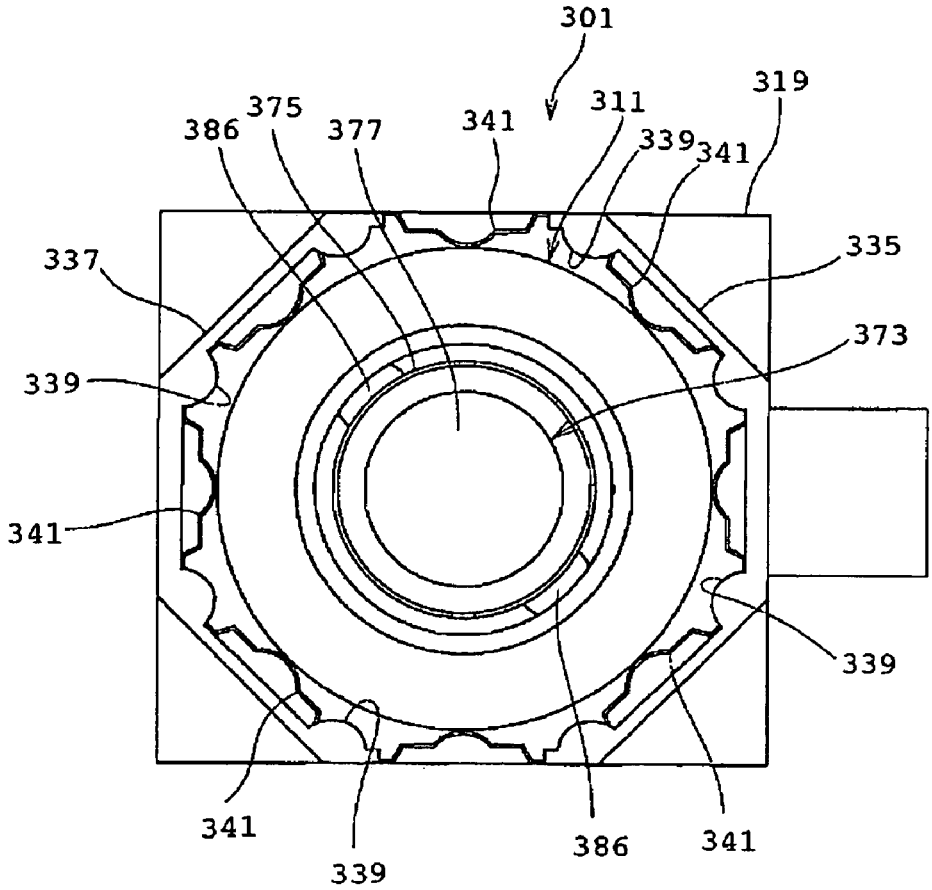
FIG. 10 is a plan view of the joystic switch having the upper case removed (Second embodiment)
Figure 11:
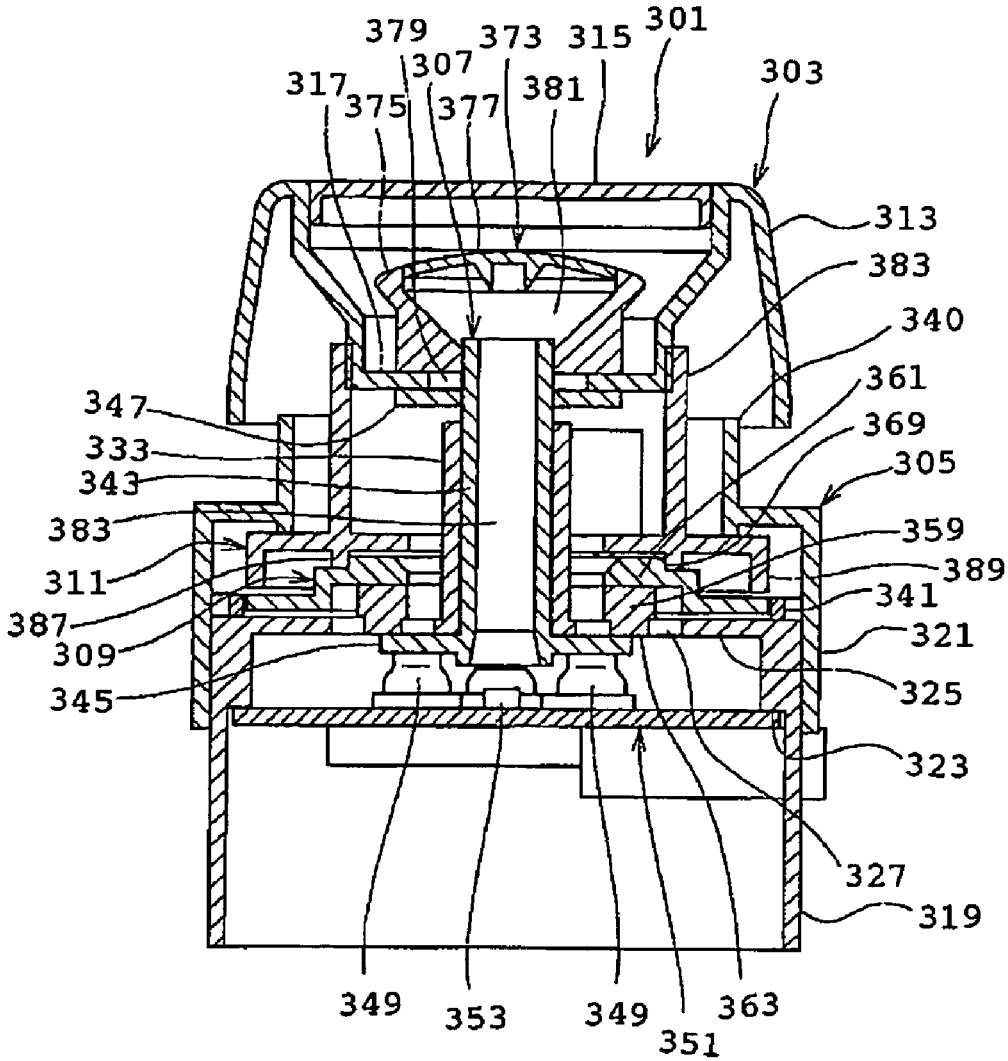
FIG. 11 is a sectional view taken on line X—X of FIG. 8 (Second embodiment)
Figure 12:
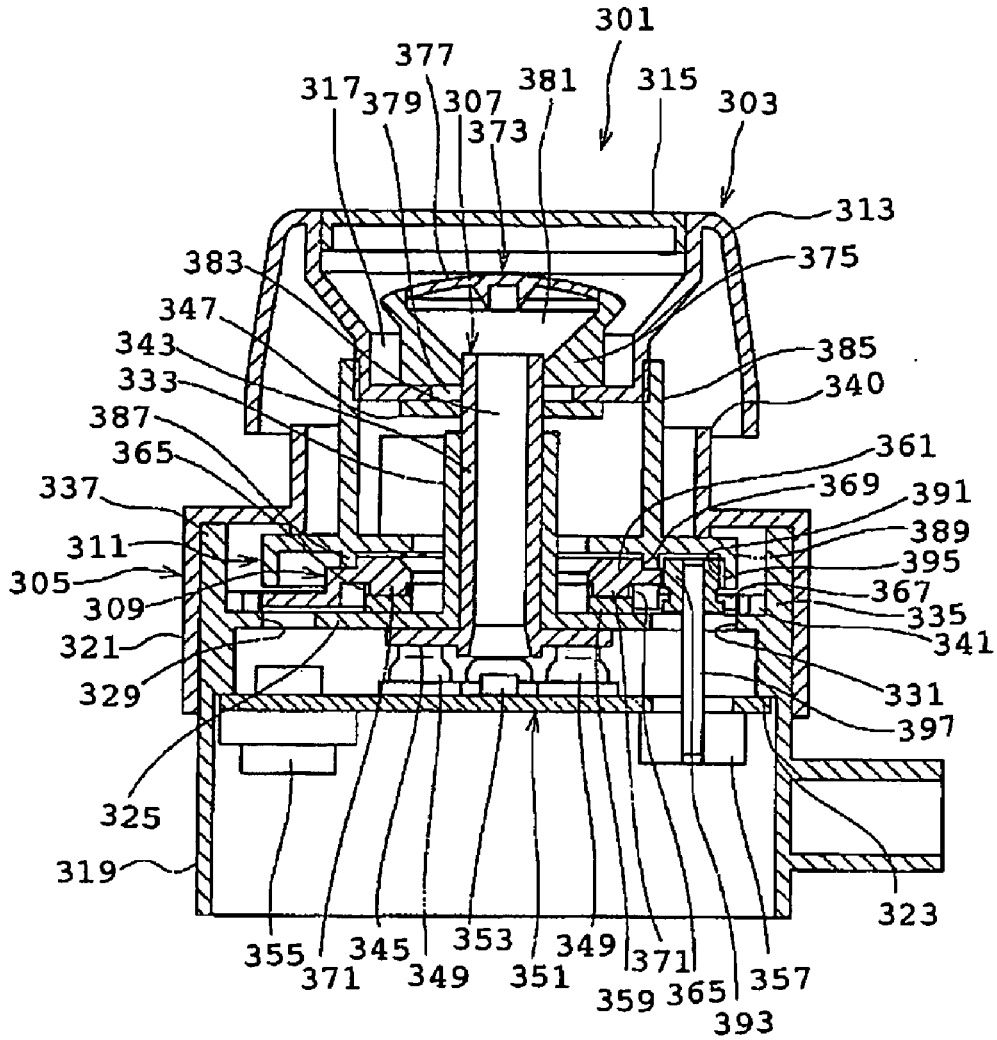
FIG. 12 is a sectional view taken on line XI—XI of FIG. 8 (Second embodiment)
Figure 13:
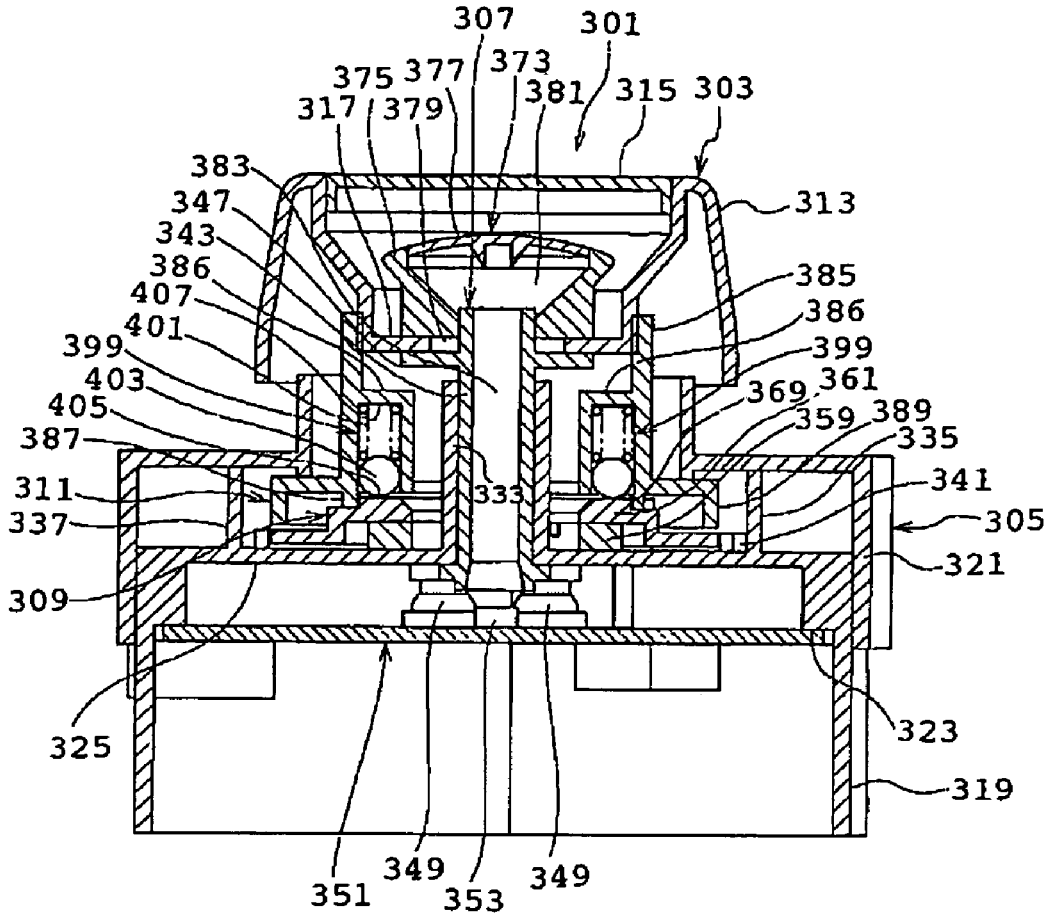
FIG. 13 is a sectional view taken on line XII—XII of FIG. 8 (Second embodiment)
Figure 14:
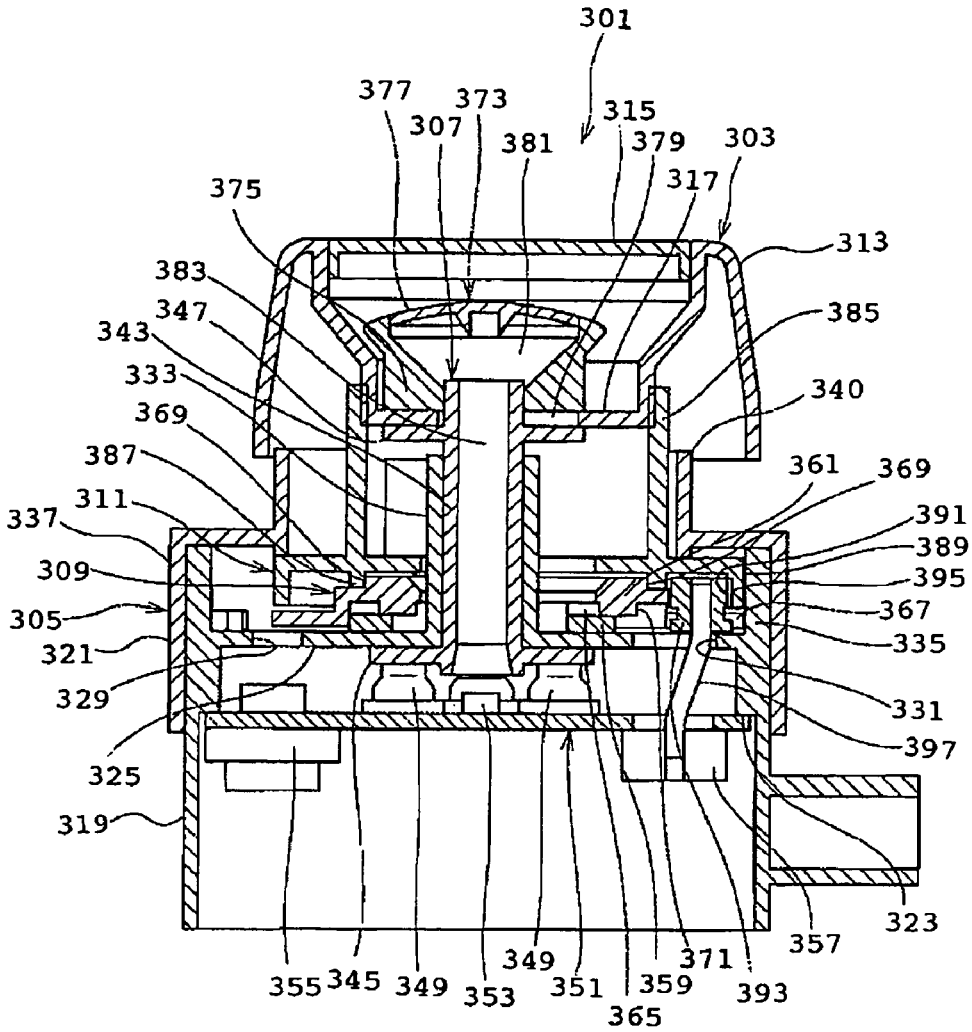
FIG. 14 is a sectional view corresponding to FIG. 12 showing a parallel movement operation (Second embodiment)
Figure 15:
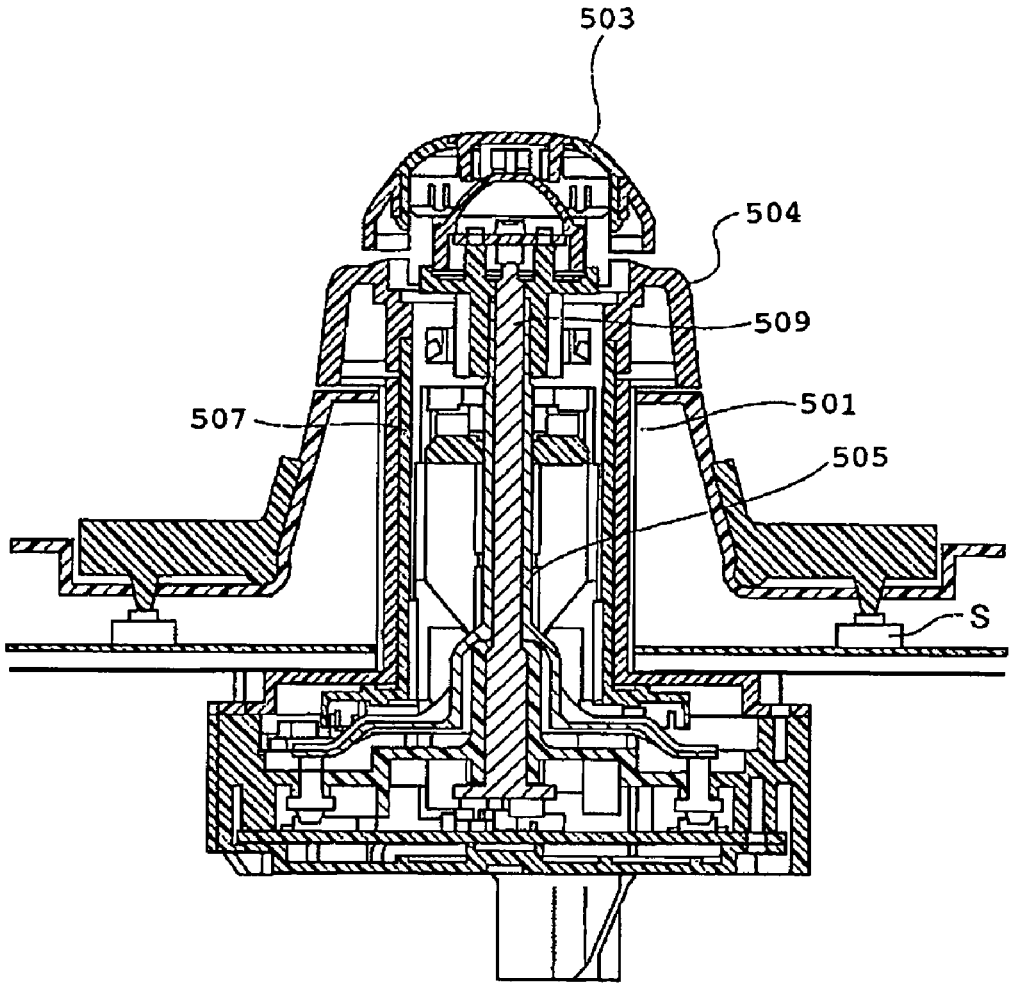
FIG. 15 is a main sectional view of ajoystic switch (Related art).

FIGS. 1 to 6 show a first embodiment of the invention. FIG. 1 is a perspective view of ajoystic switch. FIG. 2 is a perspective view of the joystic switch having a knob and an upper case removed. FIG. 3 is a plan view of the joystic switch. FIG. 4 is a sectional view taken on line IV—IV of FIG. 3. FIG. 5 is a sectional view taken on line V—V of FIG. 3. FIG. 6 is a sectional view taken on line VI—VI of FIG. 3. FIGS. 7 to 14 show a second embodiment of the invention. FIG. 7 is a perspective view of a joystic switch. FIG. 8 is a plan view of the joystic switch. FIG. 9 is a perspective view of the joystic switch having a knob and an upper case removed. FIG. 10 is a plan view of the joystic switch having the knob and the upper case removed. FIG. 11 is a sectional view taken on line X (V)-X(V) of FIG. 8. FIG. 12 is a sectional view taken on line XI(VI)-XI(VI) of FIG. 8. FIG. 13 is a sectional view taken on line XII(VII)-XII(VII) of FIG. 8. FIG. 14 is a sectional view corresponding to FIG. 12 that represents the parallel movement operation. In the description hereinafter, the axial direction of the turning knob will be referred to as a knob turning axial direction, the radial direction of the turning knob will be referred to as a knob turning radial direction, and the circumferential direction of the turning knob will be referred to as a knob turning circumferential direction.

Referring to FIGS. 1 to 6, a joystic switch 1 as a JOYSTIC INPUT DEVICE according to the embodiment of the invention includes a knob 3 protruding from a case 5 which contains a parallel operating portion 7, a rotor 9 and the like.

The knob 3 is formed of a non-turning portion 11 in the center and an operating portion 13 attached thereto so as to be allowed to have relative turning with respect to the non-turning portion 11. The knob 3 is operated to have the parallel movement and depressing operations with respect to the case 5 and have the turning operation of the operating portion 13.

The non-turning portion 11 formed of a translucent material has a hollow portion 15, and a top cover 17 on which characters and marks representing the operation method and operating directions are displayed. A flange 19 is provided around an outer circumference of the non-turning portion 11.

The operating portion 13 has a grip portion 21 so as to be gripped by a user's hand, a joint cylindrical portion 23 therein, and a turn engagement portion 25 at the lower side. The non-turning portion 11 is relatively turnably engaged with the joint cylindrical portion 23. A stopper 27 is inserted between the non-turning portion 11 and the operating portion 13, and is fixed to an inner periphery of the operating portion 13 through a press-fit process or an adhesive. The flange 19 of the non-turning portion 11 is interposed between the stopper 27 and the joint cylindrical portion 23.

The knob 3 is structured to operate the detecting portion in response to the operation either the parallel movement and depressing of the non-turning portion 11 and the operating portion 13, or the turning operation of the operating portion 13.

The case 5 formed of a lower case 29 and an upper case 31 has a rectangular plan view. The lower case 29 is detachably screwed to the upper case 31 that is mounted in the vehicle.

The lower case 29 is provided with a lever guide 32 (see FIGS. 5 and 6), a pair of positioning support portions 33 (see FIGS. 2 and 4), and protrusions 34 (see FIGS. 2 and 4). A pair of taper holes 36 and 38 opposite with each other are formed in the lever guide 32. The protrusions 34 regulate tilting of a second slider 41 of the parallel operating portion 7 at four points in the knob circumferential direction together with a positioning engagement portion (described later). The upper case 31 has a cylindrical portion 35 in its center, having a pair of first slide rails 37 on the inner peripheral surface.

The parallel operating portion 7 provided with first and second sliders 39 and 41 serves to support the knob 3 that is allowed to perform the parallel movement and depressing operations while having the turning operation regulated with respect to the case 5.

The outer circumference of the first slider 39 is formed into a rectangular shape, and the inner circumference thereof is formed into a circular shape. A first slide groove 43 is formed on one side surface of the first slider 39, and a second slide rail 45 is provided on the other side surface thereof. The first slide groove 43 is fit with a first slide rail 37 of the upper case 31. The first slider 39 is provided moveable to one direction with respect to the upper case 31 of the case 5.

A second slide groove 47 is formed in one side surface of the outer circumference of the second slider 41. The second slide groove 47 is fit with the second slide rail 45 of the first slider 39, and the first slider 39 is provided with the second slider 41 directly to the one direction.

Each of the first and the second slide rails 37, 45 and the first and the second slide grooves 43, 47 may have a space used as grease space or the space with which the oil containing plastic is fit.

The second slider 41 has a guide cylinder 51 in the center, into which the non-turning portion 11 of the knob 3 is inserted to be turnably engaged so as to allow the depressing operation. The aforementioned engagement may be performed by engaging a protrusion formed on the non-turning portion 11 with a slit formed on the guide cylinder 51 in the knob turning axial direction. The engagement of the protrusion with the slit is made through a snap fit, and the knob 3 is retained to the second slider 41.

The guide cylinder 51 is provided with a rod support portion 53 having the inner periphery formed as a through hole 55. Four push rods 57 are supported at the rod support portion 53 each at an angle of 90°. Each of the push rods 57 has a flange 58 so as to be engaged with the rod support portion 53. The push rode 57 has a top portion 59 formed into a smooth hemispheric shape which abuts against the non-turning portion 11 of the knob 3.

The second slider 41 includes a screw cramp portion 61 (FIG. 4) and a turning detent support portion 63 (FIG. 6) at the outer circumference of the guide cylinder 51.

A board 65 is fixed to the second slider 41 with a screw 67 that is tightened with the screw cramp portion 61.

Rubber contacts 69 as detecting portions that correspond to the depressing operation are provided on one side surface of the board 65. The rubber contacts 69 are attached at four positions in the circumferential direction each at an angle of 90°, abutting against the flange 58 of the push rod 57. The rubber contact 69 elastically deforms upon reception of the pressing force from the push rod 57 so as to operate the corresponding contact.

An LED 71 as a light unit is provided on the board 65 opposite the through hole 55. Rubber contacts 73 (FIGS. 5 and 6) as detecting portions that correspond to the parallel movement operation are provided on the other side of the board 65. The rubber contacts 73 are attached at four positions on a circumference. A photo sensor 75 as a detecting portion that corresponds to the turning operation is provided on the board 65. The photo sensor 75 may be replaced by other kind of turning detecting sensor.

The detecting portions independently operated in response to the parallel movement, turning, and depressing of the knob 3 are provided on the single board 65.

Another board to be placed around the lower portion of the operating portion 13 may be added to the second slider 41 such that a sensor for detecting turning operations, for example, the photo sensor is provided thereon. Such structure allows the turning operation of the operating portion 13 to be directly detected while eliminating the rotor 9.

A spherical holder 77 (FIGS. 5 and 6) is tightened at one side of the other side surface of the board 65 with the screw 67. The spherical holder 77 has a spherical recess portion 79 and a taper hole 81 formed therein, at which a lever 83 is supported. The lever 83 is inserted into the tapered holes 36, 38 of the lever guide 32. The lever 83 is provided with a disc portion 85 and a spherical portion 87. The convex side of the spherical portion 87 is supported at the concave portion 79 of the spherical holder 77. The disc portion 85 is provided opposite the rubber contact 73. A concave side of the spherical portion 87 of the lever 83 receives a top end spherical surface 91 of a pin 89. The pin 89 is fixed to the board 65 through caulking.

A positioning engagement portion 93 is provided between the second slider 41 and the positioning support portion 33. The positioning engagement portion 93 allows the second slider 41 to move in the knob turning radial direction with respect to the lower case 29 while being engaged or disengaged against the elastic force.

Referring to FIG. 4, the positioning engagement portion 93 is formed of pins 97 urged against a coil spring 95, and a detent protrusion 99 engaged therewith. The pins 97 urged against the coil spring 95 are accommodated in accommodation holes 101 formed on the lower case 29 of the case 5 at one side of the second slider 41. The detent protrusion 99 is provided on the second slider 41 at the other side. The respective pins 97 are elastically in contact with the detent protrusion 99. It is possible to provide the coil spring 95 and the pins 97 on the second slider 41 so as to form the detent protrusion 99 on the lower case 29.

The detent protrusion 99 is formed to have two stages including a positioning protrusion 103 that is spherical and provided in the center, and the spherical return protrusion 105 around the positioning protrusion 103.

The rotor 9 is interposed between the upper case 31 and the second slider 41 so as to be rotatably supported. The rotor 9 is provided with a turning receiving portion 107 at one side, and a comb-like portion 109 around the periphery of the other side for detecting the turning operation. The operating portion 13 of the knob 3 is turnably engaged with the turning receiving portion 107 in the knob turning axial direction so as to be relatively moveable. A turning detent engagement portion 111 is interposed between the rotor 9 and the turning detent support portion 63 of the second slider 41.

As shown in FIG. 6, the turning detent engagement portion 111 regulates the rotation of the rotor 9 with respect to the second slider 41, and is formed of balls 115 urged against the coil springs 113 and detent protrusions 117 engaged with the balls 115. The ball 115 urged against the coil spring 113 is accommodated in an accommodation hole 119 formed on the turning detent support portion 63 of the second slider 41 selected from the rotor 9 and the second slider 41. The detent protrusion 117 is formed to be connected to the rotor as the other one selected from the second slider 41 and the rotor 9 in the circumferential direction such that the respective balls 115 are elastically in contact with the detent protrusions 117, respectively. Alternatively, it is possible to provide the coil springs 113 and the balls 115 to the rotor 9, and to provide the detent protrusions 117 to the second slider 41.

[Parallel Movement Operation]

The user is allowed to grip the grip portion 21 of the knob 3 so as to perform the parallel movement in one of eight directions of A to H as shown in FIG. 3. The aforementioned operation allows the non-turning portion 11 and the operating portion 13 of the knob 3 to move in parallel together such that the operating force is transferred to the second slider 41 via the guide cylinder 51. The operating force is sequentially transferred from the second slider 41 to the first slider 39, and further to the upper case 31. The first slider 39 is guided by the first slide rail 37 and the first slide groove 43 to be slidably moved in one direction. The second slider 41 is also guided by the second slide rail 45 and the second slide groove 47 to be slidably moved in the direction perpendicular to the first slider 39. The aforementioned sliding movements of both the first and the second sliders regulates the turning of the second slider 41 that is about to move in one direction from A to H with respect to the upper case 31. The aforementioned regulation allows the knob 3 to perform only the parallel movement operation in the knob turning radial direction from A to H. This makes it possible to allow the turning detent engagement portion 111 between the rotor 9 and the second slider 41 to effectively perform its function.

Through the above-described parallel movement operation, the second slider 41 and the board 65 move in the manner as shown in FIG. 5.

The movement of the second slider 41 and the board 65 causes the spherical portion 87 of the lever 83 to rotate with respect to the top spherical surface 91 of the pin 89 such that the lever 83 tilts in the direction where the board 65 moves. The tilting motion of the lever 83 is guided by the taper holes 36 and 38 of the lever guide 32.

The tilting motion of the lever 83 causes the disc portion 85 to elastically deform the rubber contact 73 so as to operate the contact.

When the lever 83 tilts toward the rubber contact 73, the contact thereof in the same direction is turned ON. When the lever 83 tilts toward the direction between two rubber contacts 73, those two rubber contacts 73 are turned ON simultaneously. Accordingly, the operations toward eight directions may be detected by four rubber contacts 73.

Instead of the rubber contacts 73, an optical sensor employed for the mouse of the personal computer may be provided to the board 65 or the lower case 29 so as to detect the relative movement thereof. As a result, the operations in 8 directions may be detected.

If the second slider 41 moves as shown in FIG. 5, the pin 97 urged against the coil spring 95 is disengaged from the positioning protrusion 103 so as to make a relative movement toward the return protrusion 105. During the movement, the reaction force is applied to the knob 3 to obtain the detent function feel.

The aforementioned movement forces the pin 97 into the accommodation hole 101 against the urging force of the coil spring 95. Accordingly, if no operation force is applied to the knob 3, the pin 97 is urged against the coil spring 95, and protrudes outward of the accommodation hole 101. The top end of the pin 97 then returns from the return protrusion 105 to the positioning protrusion 103 so as to be positioned. This makes it sure to allow the second slider 41 to move to a neutral position before the parallel movement operation, and accordingly, the knob 3 automatically returns to the original position before such operation.

[Turning Operation]

When the user grips the grip portion 21 of the knob 3 to turn the operating portion 13, it relatively turns around the non-turning portion 11 such that the turning is transferred from the turning engagement portion 25 to the rotor 9 via the turning receiving portion 107. The transfer of the turning operation rotates the rotor 9 to cause the comb-like portion 109 to make a relative rotary movement with respect to the photo sensor 75 that detects such rotary movement.

During rotary operation of the knob 3, the rotor 9 relatively rotates with respect to the second slider 41. Accordingly the ball 115 urged against the coil spring 113 passes over the detent protrusion 117 to obtain the detent function feel.

[Depressing Operation]

When the user depresses the knob 3, the non-turning portion 11 and the operating portion 13 move toward the depressing direction together, and the non-turning portion 11 is pushed toward the guide cylinder 51. The force for depressing the knob 3 is transferred from the end surface of the non-turning portion 11 to the push rod 57 so as to elastically deform the rubber contact 69. The rubber contact 69 is then activated to turn the corresponding contact ON so as to detect the depressing operation.

Upon release of the user's hand from the knob 3, the depressing force is no longer applied to the rubber contact 69. Then the elastic return force of the rubber contact 69 is recovered to push the knob 3 to assume the original state. It is possible to add the return spring for returning the knob 3. Alternatively, the detent function feel may be provided to the rubber contact 69 so as to make the user feel the existence of the detent.

[Light]

Upon emission of the LED 71, the light ray passes through the through hole 55 of the second slider 41 and the center portion 15 of the knob 3 to reach the top cover 17 so as to be illuminated.

The invention allows the parallel movement, turning, and depressing operations to be performed by a single operation of the knob 3.

The non-turning portion 11 of the knob 3 is remained stationary irrespective of the turning operation of the operating portion 13. This makes it possible to easily identify the characters and marks on the top cover 17, indicating the operation method and the operation directions.

As the parallel movement operation may be made without tilting the knob 3, tilting operation does not have to be brought into close to the parallel movement pseudoly, thus reducing the whole size of the device.

The rubber contacts 69, 73 and the photo sensor 75 are disposed on the single board 65 each as the detecting portion that operates independently upon the parallel movement, turning, and depressing operations, respectively. This makes it possible to reduce the number of parts to be used, thus simplifying management of the assembly parts as well as make the device compact.

The operating portion 13 of the knob 3 relatively turnably provided to the case 5 and the parallel operating portion 7 is provided with the rotor 9 allowed to be relatively moved and turnably engaged in the knob turning axial direction. Accordingly, the turning of the knob 3 may be easily detected by the photo sensor 75 disposed on the board 65, thus easily realizing the integration of the board 65.

Second Embodiment

Referring to FIGS. 7 to 13, a joystic switch 301 as a JOYSTIC INPUT DEVICE according to another embodiment of the invention includes a knob 303 protruding from a case 305 which contains a push rod 307, a parallel operation portion 309, a rotor 311 and the like.

The knob 303 is operated by the user to perform parallel movement, turning, and depressing operations with respect to the case 305 so as to operate the detecting portions corresponding to the aforementioned operations, respectively. The knob 303 includes the grip portion 313 formed to be gripped by the user's hand, and provided with a translucent transparent cover 315 on the top portion. It is further provided with a flange 317 at the inner end portion as an interlocked engagement portion in the circumferential direction. The cover 315 serves to cover the display portion to be described later.

The case 305 formed of a lower case 319 and an upper case 321 has a rectangular plan view. The lower case 319 is detachably screwed to the upper case 321 that is mounted in the vehicle.

A stepped portion 322 for fixing the board (FIGS. 11 to 13) is formed inside the lower case 319. A top cover 325 of the lower case 319 has a slide slit 327 (FIG. 11) and through holes 329 and 331 (FIG. 12). A guide cylinder 333 is provided at the center of the top cover 325, and a pair of regulating walls 335 and 337 (FIGS. 9 and 10) are provided to face with each other, interposing the guide cylinder 333. Each of the regulating walls 335 and 337 is provided with a guide protrusion 339 as a guide portion that regulates the parallel movement of the parallel operating portion 309. The guide protrusions 339 guide the rotor 311 toward the direction selected from A to H shown in FIG. 8 when the rotor 311 performs the parallel movement together with the knob 303 such that the parallel movement of the parallel operating portion 309 is regulated in one of eight directions. The parallel movement of the knob 303 in the aforementioned direction, thus, is allowed.

A leaf spring 341 (FIGS. 9 and 10) as an elastic member is disposed between the respective guide protrusions 339. The leaf spring 341 is elastically in contact with the outer circumference of the second slider (to be described later) of the parallel operation portion 309 so as to be urged. The knob 303, thus, is brought into the neutral position before the operation. The leaf spring 341 applies the detent function feel to the parallel movement of the knob 303 through the reverse operation via the second slider and the rotor 311 (to be described later).

The upper case 321 is provided with a cylinder portion 340 in its center.

The push rod 307 (FIGS. 11 to 13) is engaged with the case 305 so as to be relatively moveable and turnably engaged in the knob turning axial direction such that the knob 303 is engaged in the knob turning axial direction.

The push rod 307 is provided with a pair of flanges 345, 347 at both end portions of a body cylinder portion 343 having a circular cross section. The body cylinder portion 343 is supported at the guide cylinder 333 of the lower case 319 so as to be relatively moveable in the knob turning axial direction. The space between the body cylinder portion 343 and the guide cylinder 333 is prevented from being rotated and dislocated by performing a snap fit to fit the protrusion with the slip, for example. One of the flanges 345 is integrally provided to the body cylinder 343 so as to be within the top cover 325 of the lower case 319. The other flange 347 is fixed to the body cylinder portion 343 through press fit or with the adhesion so as to be located outside the guide cylinder 333.

The flange 345 of the push rod 307 abuts against rubber contacts 349 each serving as a detecting portion corresponding to the depressing operation. When the depressing force is applied to the rubber contacts 349 from the push rod 307, they elastically deform to operate the contact. They are arranged at four positions in the circumferential direction of the knob each at an angle of 90° on the board 351. The board 351 (FIGS. 11 to 13) is provided to the stepped portion 323 of the lower case 319.

The board 351 is provided with an LED 353 as a light unit opposite the cylinder portion 343. The board 351 is further provided with a position detection sensor 355 (FIG. 12) serving as a detecting portion that detects a parallel movement of the parallel operating portion 309 in response to the parallel movement operation. The position detection sensor 355 is disposed opposite the through hole 329 of the lower case 319 at the outer circumferential side of the rubber contact 349. The position detection sensor 355 is formed of, for example, an optical sensor employed for the mouse for a personal computer. The aforementioned position detection sensor 355 may be replaced by the sensor of magnetic type or of contact type. The board 351 is further provided with a turning sensor 357 as a detecting portion in response to the turning operation of the knob 303.

Accordingly, the detecting portions independently operated in response to the parallel movement, turning, and depressing operations of the knob 303 may be provided on the single board 351.

A plurality of boards may be employed such that the turning sensor 357 is replaced by the photo sensor provided at the side wall of the upper case 321.

The parallel operating portion 309 (FIGS. 9 to 13) including first and second sliders 359 and 361 (FIGS. 11 to 13) is provided in the knob turning radial direction so as to be operated while having the turning operation regulated with respect to the case 305.

The first slider 359 having a circular inner/outer circumferential shape is arranged on the top cover 325 of the lower case 319. A first slide protrusion 363 (FIG. 11) is provided on one side surface of the first slider 359. A slide groove 365 (FIG. 12) is formed on the other side surface. The slide groove 365 is provided perpendicular to a slide slit 327 of the lower case 319. The first slider 359 is provided such that the first slide protrusion 363 fits with the slide slit 327 of the lower case 319 so as to be moveable toward one direction with respect to the lower case 319 of the case 305.

The second slider 361 shaped to have a circular inner/outer circumference and a stepped cross section is provided with a turning fit portion 369 at one side surface, and a second slide protrusion 371 at the other side surface. The second slide protrusion 371 fits with the slide groove 365 of the first slider 359 such that the second slider 361 is provided to the first slider 359 so as to be moveable in the direction perpendicular to the aforementioned one direction. A shaft support hole 367 is formed on the second slider 361 on the outer circumferential portion at one side.

Each of spaces between the slide slit 327 and the first slide protrusion 363, and between the slide groove 365 and the second slide protrusion 371 may have space formed as grease space or the space with which the oil containing plastic is fit.

A display portion 373 is provided on the top end of the push rod 307, which is obtained by press fitting or adhering a transparent illumination plate 377 formed of a translucent material with or to a hollow holder 375. Characters and marks are displayed on the illumination plate 377. The display portion 373 is fixed by press fitting or adhering a holder 375 with or to the top end of the push rod 307. The circumferential guide groove 379 is formed between the push rod 307 and the display portion 373. In the aforementioned state, the LED 353 forms an optical path from the hollow portion 381 of the display portion 373 and the hollow portion 383 of the body cylinder portion 343 to reach the illumination plate 377 of the display portion 373 so as to allow the LED 353 to illuminate the illumination plate 377 of the display portion 373.

The guide groove 379 is engaged with the flange 317 of the knob 303 in the knob turning axial direction so as to be relatively turnable. The inner diameter of the flange 317 is larger than the outer diameter of the body cylinder portion 343 to leave a gap therebetween such that the flange 317 is allowed to relatively moveable in the knob turning radial direction with respect to the guide groove 379.

The rotor 311 is relatively turnably provided to the parallel operation portion 309 such that the knob 303 is relatively moveably and turnably engaged with the rotor 311 in the knob turning axial direction. The rotor 311 has its inner/outer circumference formed into a circular shape. A turning receiving cylinder 385 is provided on one side surface of the rotor 311, and a turning fit cylinder 387 on the other side surface. The inner circumference of the turning receiving cylinder 385 is provided with a pair of turning detent support portions 386 (FIG. 13). The outer circumference of the rotor 311 is provided with an outer cylinder portion 389. An inner gear 391 is formed on the inner circumference of the outer cylinder portion 389.

In the rotor 311, the turning fit cylinder 387 relatively turnably fits with the turning fit portion 369 of the second slider 361. The knob 3 is turnably engaged with the turning receiving portion 385 of the rotor 311 in the knob turning axial direction so as to be relatively moveable.

The inner gear 391 of the rotor 311 is in mesh with an outer gear 395 of a shaft 393 that is turnably supported in a shaft support hole 367 of the second slider 361. A flexible cable 397 is fixed to the shaft 393, and drawn from the through hole 331 of the lower case 319 to the board 351 to be inserted into the turning sensor 357 in the knob turning axial direction so as to be relatively moveable and turnably engaged. Accordingly, the turning of the knob 303 is transferred to the turning sensor 357 via the rotor 311, the inner/outer gear units 391, 395, the shaft 393, and the flexible cable 397 such that the turning is detected.

A turning detent engagement portion 399 (FIG. 13) is provided between the rotor 311 and the turning detent support portion 386 of the second slider 361.

The turning detent engagement portion 399 applies the turning detent to the rotor 311 with respect to the second slider 361. The turning detent engagement portion 399 is formed of balls 403 urged against the coil spring 401, and detent protrusion 405 engaged therewith. The ball 403 urged against the coil spring 101 is accommodated in the accommodation hole 407 formed on the turning detent support portion 386 of the rotor 311 selected from the rotor 311 and the second slider 361. A detent protrusion 405 is continuously formed on the second slider 361 as the other circumference. The balls 403 are elastically in contact with the detent protrusions 405, respectively. It is possible to provide the coil spring 401 and the balls 403 to the second slider 361, and the detent protrusion 405 on the rotor 311.

[Parallel Movement Operation]

The user is allowed to grip the grip portion 313 of the knob 303 so as to perform the parallel movement in one of eight directions of A to H as shown in FIG. 8. The above-described operation allows the flange 317 of the knob 303 to relatively move in the knob turning radial direction in the guide groove 379 at the side of the push rod 307.

The relative movement causes the knob 303 to move in parallel such that the operation force is transferred to the rotor 311 via the turning receiving cylinder 385. The operating force is transferred from the rotor 311 to the second slider 361 via a turning fit cylinders 387 and 369.

The operation force is sequentially transferred from the second slider 361 to the first slider 359, and the lower case 319. The first slider 359 is guided by the slide slit 327 and the first slide protrusion 363, and the second slider 361 is slid by the slide groove 365 and the second slide protrusion 371 with respect to the first slider 359.

The aforementioned slide operations regulate the turning when the second slider 361 moves in the knob turning radial direction with respect to the lower case 319. The regulation of the turning makes it possible to allow the knob 303 to have the parallel movement in the knob turning radial direction in the direction from A to H. The turning detent engagement portion 399 between the rotor 311 and the second slider 361 may be efficiently functioned.

If the operation direction from A to H displaces from the parallel movement operation to a certain degree, the outer circumference of the rotor 311 abuts against one of a pair of guide protrusions 339 in the operating direction. The aforementioned sliding adjusts the operating direction such that the outer circumference of the rotor 311 abuts against a pair of guide protrusions 339 in the operating direction. This makes it possible to allow the knob 303 to accurately move in parallel in one of directions from A to H easily and accurately.

The parallel movement operation allows the position detection sensor 355 to detect the position of the second slider 359 in the through hole 329.

When the second slider 359 is moved by the parallel movement as shown in FIG. 14, the leaf spring 341 deforms in the operating direction, and inverses in the middle of the deformation. The aforementioned inverse operation rapidly reduces the reaction force to the knob 303 to which the detent is applied.

When the operating force applied to the knob 303 is released, the inversion of the leaf spring 341 automatically returns to apply the return force to the second slider 359. Accordingly, this makes it sure to allow the second slider 359 to move to the neutral position before the parallel movement operation, thus automatically returning the knob 303 to the original position before such operation.

[Turning Operation]

When the user grips the grip portion 313 of the knob 303 so as to be turned, the flange 317 of the knob 303 relatively turns around the knob turning axis in the guide groove 379 at the side of the push rod 307. Accordingly, the display portion 373 is remained stationary in position irrespective of the turning operation of the knob 303.

The knob 303 is turned by the relative turning such that the turning force is transferred to the rotor 311 via the turning receiving cylinder 385. The turning force is further transferred to the turning sensor 357 via the inner and outer gears 391, 395, the shaft 393, and the flexible cable 397. The turning is, thus, detected by the turning sensor 357.

During the turning operation of the knob 3, the rotor 311 relatively rotates with respect to the second slider 361. The ball 403 urged against the coil spring 401 passes over the detent protrusion 405 to apply the detent function.

[Depressing Operation]

When the knob 303 is depressed, the depressing force is transferred from the flange 317 of the knob 303 to the flange 347 of the push rod 307 so as to be depressed to move toward the guide cylinder 333. Accordingly, the display portion 373 moves in the depressing direction accompanied with the depressing of the knob 303.

As the push rod 307 moves, the rubber contact portion 349 is elastically deformed via the flange 345. The rubber contact 349 is, thus, operated to turn the contact ON so as to detect the depressing operation.

Upon release of the user's hand from the knob 303, the depressing force is no longer applied to the rubber contact 349. The elastic return force of the rubber contact 349 serves to push up the knob 303 to return. An additional spring may be provided for returning the knob 303. It is possible to apply the detent feel to the user during the depression of the knob while applying the detent function to the rubber contact 349.

[Light]

Upon operation of the LED 353 to emit the light, the light passes through the hollow portions 383 and 381 of the push rode 307 and the display portion 373 to directly reach the illumination plate 377. The illumination plate 377 is illuminated to identify the characters thereon through the cover 315.

It is to be noted that the display portion 373 is remained stationary in position irrespective of the parallel movement and turning operations of the knob 303, thus identifying the display portion 373 easily.

The parallel movement, turning, and depressing operations may be performed by a single operation of the knob 303.

Upon parallel movement operation, the knob 303 does not have to be structured to bring the tilting operation pseudoly close to the parallel movement, thus reducing the size of the device.

The rubber contacts 349, the position detection sensor 355, and the turning sensor 357 are provided on the single board 351 each independently operated in response to the parallel movement, turning, and depressing operations of the knob 303, respectively. This makes it possible to reduce the number of parts, thus facilitating management of the assembly components. Also, the device may be formed into a compact structure.

As the knob 303 attached to be relatively turnable with respect to the parallel movement portion 309 is provided with the rotor 311 that is engaged so as to be relatively moved and turnably engaged, the turning of the knob 303 may be easily transferred to the single board 351 easily such that the turning sensor 357 is allowed to detect turning of the knob 303. This makes it possible to integrate the board 351 easily.

What is claimed is:

1. A JOYSTIC INPUT DEVICE comprising:

a knob formed of a non-turning portion in a center, and an operating portion provided around the non-turning portion so as to be relatively turnable such that a parallel movement operation and a depressing operation of the non-turning portion and the operating portion, and a turning operation of the operating portion are performed with respect to a case; and a parallel operating portion supports the knob such as to allow the parallel movement and depressing operations of the non-turning portion and the operating portion, and the turning operation of the operating portion while receiving a turning regulation with respect to the case, wherein a detecting portion is operated in response to one of corresponding parallel movement and depressing operations of the non-turning portion and the operating portion, and the turning operation of the operating portion.

2. The JOYSTIC INPUT DEVICE according to claim 1, further comprising a single board provided with the detecting portions.

3. The JOYSTIC INPUT DEVICE according to claim 2, further comprising a rotor provided relatively turnable to the case and the parallel operating portion, and with which the operating portion of the knob is turnably engaged in a knob turning axial direction.

4. The JOYSTIC INPUT DEVICE according to claim 2 or 3, wherein:

the board is integrally provided with the parallel operating portion of the knob so as to be operated;

the board with a light unit:

a display portion is provided on the non-turning portion of the knob;

an optical path is formed from the light unit to the display portion is formed; and the light unit illuminates a display of the display portion.

5. The JOYSTIC INPUT DEVICE according to claims 2 or 3, wherein the parallel operating portion is provided with the board.

6. The JOYSTIC INPUT DEVICE according to any one of claims 1 to 3, wherein:

the parallel operating portion includes a first slider and a second slider;

the first slider is provided so as to be relative movable to one direction of the case, and the second slider is provided so as to be moveable toward a direction perpendicular to the one direction in which the first slider moves; and the non-turning portion of the knob depressible relative to the second slider and engages the second slider in the turning direction.

7. The JOYSTIC INPUT DEVICE according to claim 6, wherein a positioning engagement portion is detachably and elastically provided between the case and the second slider so as to allow the second slider to move in a radial direction of the knob with respect to the case.

8. The JOYSTIC INPUT DEVICE according to claim 7, wherein the positioning engagement portion comprises a ball provided in one of the case and the second slider and urged against a coil spring, and a detent protrusion provided in the other one of the case and the second slider so as to be engaged with the ball.

9. The JOYSTIC INPUT DEVICE according to claim 6, wherein the second slider is provided with a turning detent engagement portion that applies a turning detent function to the rotor in a space between the rotor and the second slider.

10. The JOYSTIC INPUT DEVICE according to claim 9, wherein the turning detent engagement portion comprises a ball provided in one of the rotor and the second slider and urged against a coil spring, and a detent protrusion provided in the other one of the rotor and the second slider so as to be engaged with the ball.

11. A JOYSTIC INPUT DEVICE comprising:

a knob performing operations of a parallel movement, a turning, and a depressing with respect to a case;

a parallel operating portion that supporting the knob that performs the operations of the parallel movement, the turning, and the depressing while receiving a turning regulation with respect to the case; and a push rod relatively moveable in a knob turning axial direction with respect to the case, which allows the knob to be engaged in the knob turning axial direction, and to be relatively moved in the knob turning radial direction and relatively turned, wherein a detection portion is operated in response to one of operations of the parallel movement, the turning, and the depression.

12. The JOYSTIC INPUT DEVICE according to claim 11, wherein the case includes a single board provided with the detecting portion.

13. The JOYSTIC INPUT DEVICE according to claim 12, further comprising a rotor provided relatively turnable to the parallel operating portion, having the knob turnably engaged in a knob turning axial direction and relatively moved.

14. The JOYSTIC INPUT DEVICE according to claim 12 or 13, wherein:

the board is provided with a light unit;

the push rod is provided with a display portion;

an optical path is formed to extend from the light unit to the display portion; and the display portion is illuminated by the light unit.

15. The JOYSTIC INPUT DEVICE according to claim 14, wherein:

the display portion is fixed to the push rod;

a circumferential guide groove is formed between the push rod and the display portion; and the knob is provided with an interlocked engagement portion that fits with the guide groove so as to be engaged in a knob turning axial direction, and relatively moveable in a knob turning radial direction.

16. The JOYSTIC INPUT DEVICE according to claim 14, wherein:

the display portion is accommodated in the knob; and the knob is provided with a transparent cover that covers the display portion.

17. The JOYSTIC INPUT DEVICE according to claims 12 or 13, wherein:

the board is provided with a turning sensor that detects a turning of the knob as the detection portion; and a flexible cable is provided to transfer the turning of the knob to the turning sensor to detect the turning.

18. The joystic device according to claim 12 or 13, wherein the board is provided with a position detection sensor that detects a parallel movement of the parallel operating portion as the detection portion.

19. The JOYSTIC INPUT DEVICE according to any one of claims 11 to 13, wherein the case is provided with a guide portion that regulates the parallel operating portion to move in parallel in one of 8 directions.

20. The JOYSTIC INPUT DEVICE according to any one of claims 11 to 13, wherein the case is provided with an elastic member that urges the parallel operating portion so as to bring the knob into a neutral position before the operation.

21. The JOYSTIC INPUT DEVICE according to claim 20, wherein the elastic member applies a detent function feel to a parallel movement operation of the knob through an inverting operation.

22. The JOYSTIC INPUT DEVICE according to any one of claims 11 to 13, wherein:

the parallel operating portion is provided with a first slider and a second slider; and the first slider is moveable in one direction with respect to the case, and the second slider is moveable in a direction perpendicular to the one direction in which the first slider moves.

23. The JOYSTIC INPUT DEVICE according to claim 22, wherein a turning detent engagement portion that applies a turning detent to the rotor with respect to the second slider is provided in a space between the rotor and the second slider.

24. The JOYSTIC INPUT DEVICE according to claim 23, wherein the turning detent engaging portion comprises a ball provided in one of the rotor and the second slider and urged against a coil spring, and a detent protrusion provided in the other of the rotor and the second slider so as to be engaged with the ball.

* * * * *